US008196879B2

(12) United States Patent
Vezina et al.

(10) Patent No.: US 8,196,879 B2
(45) Date of Patent: Jun. 12, 2012

(54) CAKE SUPPORT TUBE

(76) Inventors: Marguerite A. Vezina, Marco Island, FL (US); Marcel Vezina, Marco Island, FL (US)

( * ) Notice: Subject to any disclaimer, the term of this patent is extended or adjusted under 35 U.S.C. 154(b) by 161 days.

(21) Appl. No.: 12/760,680

(22) Filed: Apr. 15, 2010

(65) Prior Publication Data

US 2010/0200722 A1 Aug. 12, 2010

(51) Int. Cl.
*F16M 11/00* (2006.01)

(52) U.S. Cl. ..... 248/176.1; 108/92; 108/101; 248/686; 248/188.2

(58) Field of Classification Search ..... 108/101, 108/92, 93; 248/686, 158, 174, 176.1, 188.2, 248/346.4
See application file for complete search history.

(56) References Cited

U.S. PATENT DOCUMENTS

| | | | | |
|---|---|---|---|---|
| 1,979,911 | A | 11/1934 | Steudel | |
| 2,902,174 | A | 9/1959 | Audsley | |
| 2,921,691 | A | 1/1960 | Dembinski | |
| 3,070,236 | A | 12/1962 | Macpherson, Sr. | |
| 3,236,389 | A * | 2/1966 | Murdock | 211/85.4 |
| 3,282,546 | A | 11/1966 | Beckerman | |
| 3,690,610 | A | 9/1972 | Peirce | |
| 3,814,032 | A | 6/1974 | McMains | |
| 4,069,772 | A | 1/1978 | Haapala | |
| 4,101,232 | A * | 7/1978 | Haapala | 403/261 |
| D278,676 | S | 5/1985 | DeAre | |
| 4,676,005 | A * | 6/1987 | Seligman | 33/533 |
| 5,165,637 | A | 11/1992 | Polley et al. | |
| 5,617,798 | A | 4/1997 | Lytell | |
| 5,690,167 | A * | 11/1997 | Rieger | 165/133 |
| 6,170,961 | B1 * | 1/2001 | Knoch | 362/234 |
| 6,185,859 | B1 * | 2/2001 | Pirkle | 43/54.1 |
| 6,585,200 | B2 * | 7/2003 | Borodulin et al. | 248/176.1 |
| 6,843,183 | B2 * | 1/2005 | Strong | 108/147.21 |
| 2005/0092189 | A1 * | 5/2005 | Hall | 99/426 |
| 2008/0087617 | A1 | 4/2008 | Harris | |
| 2008/0236803 | A1 * | 10/2008 | Cao et al. | 165/179 |

* cited by examiner

*Primary Examiner* — Bradley Duckworth
(74) *Attorney, Agent, or Firm* — The Livingston Firm; Edward M. Livingston, Esq.; Bryan L. Loeffler, Esq.

(57) ABSTRACT

A support tube (1) for use as an internal support for multi-tiered cakes (9). The support tube has a raised internal profile (7) comprised of raised ridges (8) located on an inner surface (5) of a perimeter wall (4). The raised internal profile strengthens the perimeter wall of the support tube, thereby allowing the support tube to support large weights of multi-tiered cakes when placed in a vertical position inside a multi-tiered cake.

2 Claims, 3 Drawing Sheets

CAKE SUPPORT TUBE

BACKGROUND OF THE INVENTION

This invention relates to internal supports for multi-tiered cakes, more particularly, a plastic tube having a raised internal profile used as an internal support for multi-tiered cakes.

Wooden dowels are commonly used by bakers as internal supports for cakes having multiple layers or tiers, such as wedding cakes, to prevent the cakes from collapsing under the weight of the upper tiers, particularly during transit of such cakes. The conventional method for assembling a multi-tiered cake is to first place each tier of the cake on a cardboard base. Then, wooden dowels are measured and cut into lengths equal to the height of the first tier. Next, dowels are inserted vertically around the center of the first tier so that the bottom of the dowels make contact with the cardboard base under the first tier and so that the tops of the dowels are flush with the top of the first tier. Then, the second tier is placed on top of the first tier so that the cardboard base of the second tier is resting on the tops of the dowels. This process is then repeated for each additional tier that is to be added to the cake. A problem with the conventional method and specifically the wooden dowels is that the dowels are hard to cut. In fact, the wooden dowels cannot be cut with scissors and must be cut with a saw and then sanded to prevent splinters. Bakers also have to worry about the cleanliness of the wood and if the wood has been treated with any chemicals. A further problem with wooden dowels is the large diameter of the dowels required for larger cakes, which decreases the amount of cake available and leaves unsightly vertical holes in the cake after the cake is dismantled to be served and eaten. An even further problem is that wooden dowels can be missed when cutting the cake for serving, thereby creating a safety hazard to individuals consuming the cake. Although, there have been prior attempts to use dowels made of materials such as plastic in the past, these attempts have been unsuccessful due to the fact that a plastic dowel requires a large diameter in order to be strong enough to hold a large vertical load.

Therefore, a need exists for sanitary dowels that are easy to cut and can hold a heavy load when being used to support a multi-tiered cake. In addition, a need exists for a dowel that can be easily seen when disassembling a multi-tiered cake.

The relevant prior art includes the following references:

| Patent No. (U.S. unless stated otherwise) | Inventor | Issue/Publication Date |
|---|---|---|
| 2008/0087617 | Harris | Apr. 17, 2008 |
| 5,617,798 | Lytell | Apr. 08, 1997 |
| 5,165,637 | Polley et al. | Nov. 24, 1992 |
| D278,676 | DeAre | May 07, 1985 |
| 4,069,772 | Haapala | Jan. 24, 1978 |
| 3,814,032 | McMains | Jun. 04, 1974 |
| 3,690,610 | Peirce | Sep. 12, 1972 |
| 3,282,546 | Beckerman | Nov. 01, 1966 |
| 3,070,236 | Macpherson, Sr. | Dec. 25, 1962 |
| GB846,440 | Heyman | Aug. 31, 1960 |
| 2,921,691 | Dembinski | Jan. 19, 1960 |
| 2,902,174 | Audsley | Sep. 01, 1959 |
| GB653,229 | Hutton et al. | Dec. 01, 1948 |
| GB491,385 | Sidwell | Sep. 01, 1938 |
| 1,979,911 | Steudel | Nov. 06, 1934 |

SUMMARY OF THE INVENTION

The primary objects of the present invention are to provide a cake support tube that can be used to support the weight of a multi-tiered cake.

Another object of the present invention is to provide a cake support tube that is made of a sanitary material.

An even further object of the present invention is to provide a cake support tube that is easy to cut down to smaller lengths.

Another object of the present invention is to provide a cake support tube that will not splinter and create a safety hazard.

An even further object of the present invention is to provide a cake support tube that can hold a large vertical load while maintaining a small diameter.

Another object of the present invention is to provide a cake support tube that saves time, labor and costs over the conventional method of making multi-tiered cakes.

An even further object of the present invention is to provide a cake support tube that is easy to find when disassembling a multi-tiered cake.

The present invention fulfills the above and other objects by providing a cake support tube having a raised internal profile preferably comprised of raised ridges on an invisible diameter of the cake support tube. The raised internal profile strengthens the perimeter wall of the cake support tube, thereby allowing the cake support tube to support large weights when placed in a vertical position inside the cake. The internal raised profile of the cake support tube also strengthens the perimeter wall of the cake support tube making it less likely that the perimeter will bend under pressure and fail. The cake support tube is preferably made of plastic, which can be easily washed and sanitized and, unlike wood, is not absorbent. Furthermore, the tubular structure allows a user to easily cut the cake support tube to a required length using only scissors. An additional feature of the present invention is that the cake support tubes may be made of brightly colored plastic which will allow a user to easily find the cake support tubes when disassembling and serving multi-tiered cake.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

With reference to FIGS. 7 and 8, a top perspective view and a cross-sectional view along line 8-8 of FIG. 7, respectively, of a cake support tube 1 of the present invention having a triangular shaped perimeter wall 4 with raised ridges 8 are illustrated.

Figure 9:
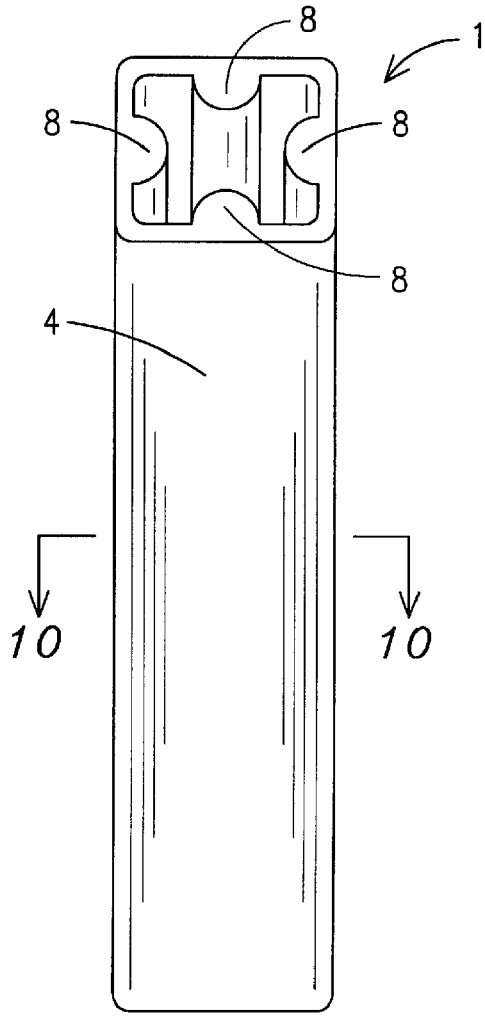
FIG. 9 is a top perspective view of a cake support tube of the present invention having rectangular shaped perimeter wall.
Figure 8:
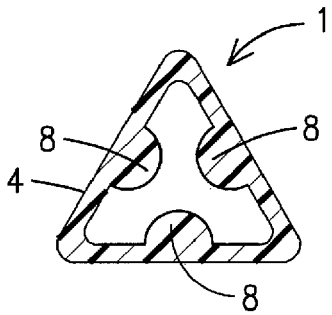
FIG. 8 is a cross-sectional view along line 8-8 of FIG. 7 of a cake support tube of the present invention.
Figure 10:
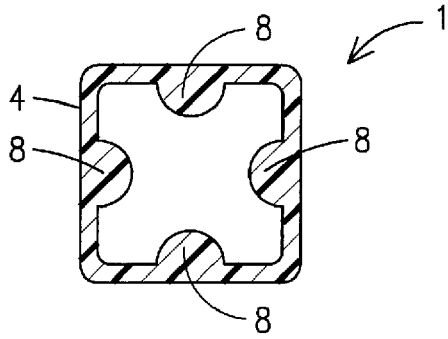
FIG. 10 is a cross-sectional view along line 10-10 of FIG. 9 of a cake support tube of the present invention.

Finally with reference to FIGS. 9 and 10, a top perspective view and a cross-sectional view along line 10-10 of FIG. 9, respectively, of a cake support tube 1 of the present invention having a rectangular shaped perimeter wall 4 with raised ridges 8 are illustrated.

DESCRIPTION OF THE PREFERRED EMBODIMENTS

Figure 1:
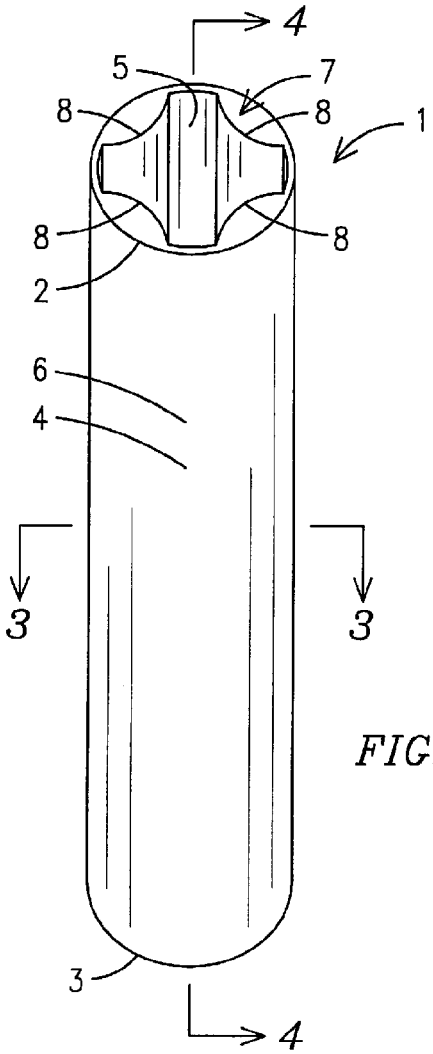
FIG. 1 is a top perspective view of a cake support tube of the present invention.
Figure 2:
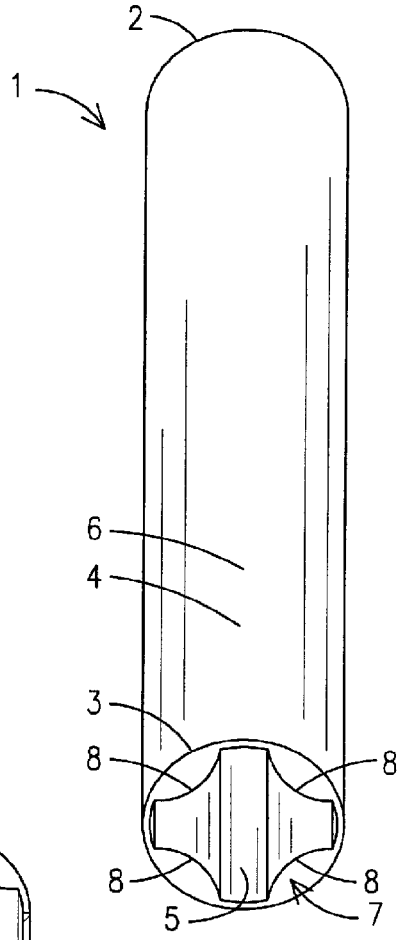
FIG. 2 is a bottom perspective view of a cake support tube of the present invention.

For purposes of describing the preferred embodiment, the terminology used in reference to the numbered components in the drawings is as follows:

1. cake support tube
2. top end
3. bottom end
4. perimeter wall
5. inner surface
6. outer surface
7. raised internal profile
8. raised ridge
9. multi-tiered cake
10. first tier
11. second tier
12. base
13. top of tier With reference to FIGS. 1 and 2, a top perspective view and a bottom perspective view, respectively, of a cake support tube 1 of the present invention are shown. The cake support tube 1 is substantially tubular. Although the cake support tube 1 shown here has a substantially round tubular shape, the cake support tube 1 may be any geometric shape, such as a rectangle, triangle, octagon, etc. The cake support tube 1 comprises a top end 2, a bottom end 3, and a perimeter wall 4 having an inner surface 5 and an outer surface 6. A raised internal profile 7 comprising at least one raised ridge 8 is locate on the inner surface 5 of the cake support tube 1. The at least one raised ridge 8 runs lengthwise along the inner surface 5 from the top end 2 of the cake support tube 1 to the bottom end 3 of the cake support tube 1. The raised internal profile 7 strengthens the perimeter wall 4 of the cake support tube 1, thereby allowing the cake support tube 1 to support large weights placed on the top end 2 of the cake support tube 1 while the cake support tube 1 is in a vertical position inside a cake. The raised internal profile 7 profile also prevents the cake support tube 1 from bending under the pressure of a large vertical weight. The cake support tube 1 is preferably made of a brightly colored plastic that will allow a user to easily find the cake support tube 1 when disassembling and serving a multi-tiered cake.

Figure 3:
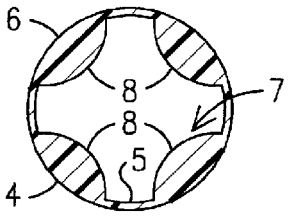
FIG. 3 is a cross-sectional view along line 3-3 of FIG. 1 of a cake support tube of the present invention.

With reference to FIG. 3, a cross-sectional view along line 3-3 of FIG. 1 of a cake support tube 1 of the present invention is shown. The cake support tube 1 comprises a perimeter wall 4 having an inner surface 5 and an outer surface 6. A raised internal profile 7 comprising at least one raised ridge 8 is locate on the inner surface 5 of the cake support tube 1. Although the cake support tube 1 shown here has a substantially round tubular shape, the cake support tube 1 may be any geometric shape, such as a rectangle, triangle, octagon, etc.

Figure 4:
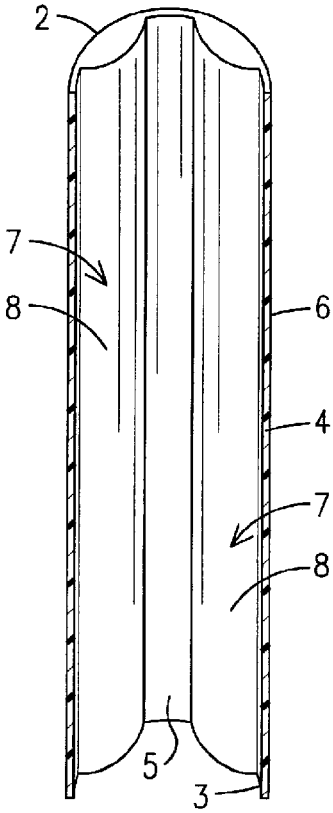
FIG. 4 is a cross-sectional perspective view along line 4-4 of FIG. 1 of a cake support tube of the present invention.

With reference to FIG. 4, a cross-sectional perspective view along line 4-4 of FIG. 1 of a cake support tube 1 of the present invention is shown. The cake support tube 1 comprises a perimeter wall 4 having an inner surface 5 and an outer surface 6. A raised internal profile 7 comprising at least one raised ridge 8 is locate on the inner surface 5 of the cake support tube 1. The at least one raised ridge 8 runs lengthwise along the inner surface 5 from the top end 2 of the cake support tube 1 to the bottom end 3 of the cake support tube 1.

Figure 5:
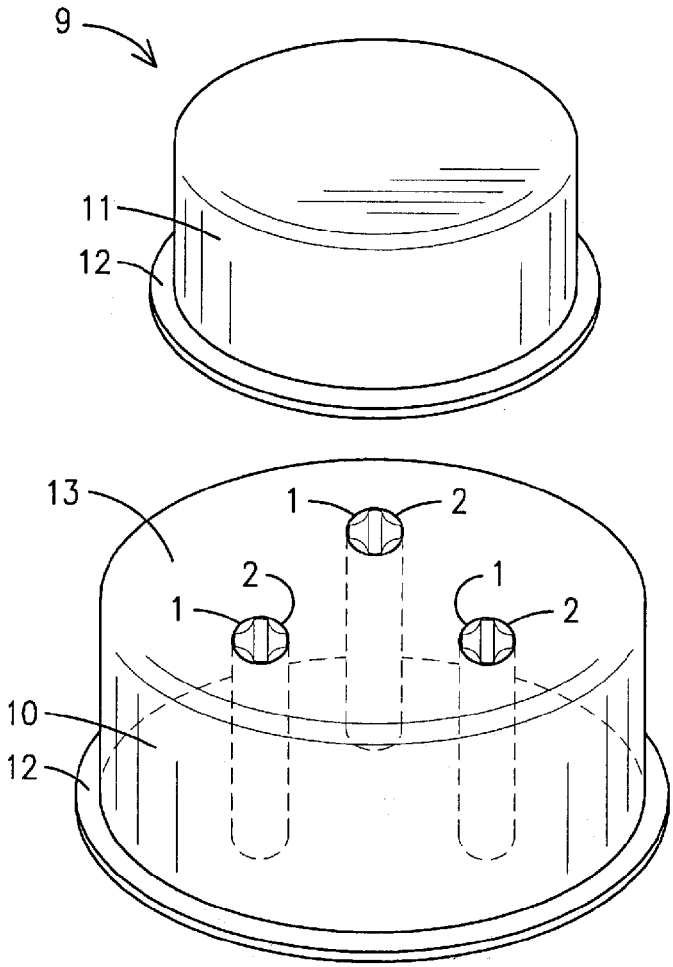
FIG. 5 is an exploded perspective side view of multi-tiered cake having a plurality of cake support tubes of the present invention located within a first tier of the multi-tiered cake.
Figure 6:
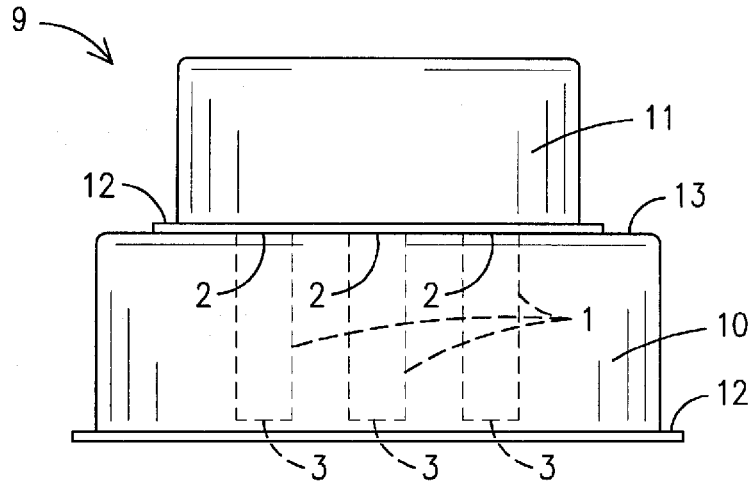
FIG. 6 is a side plan view of multi-tiered cake having a plurality of cake support tubes of the present invention located within a first tier of the multi-tiered cake.
Figure 7:
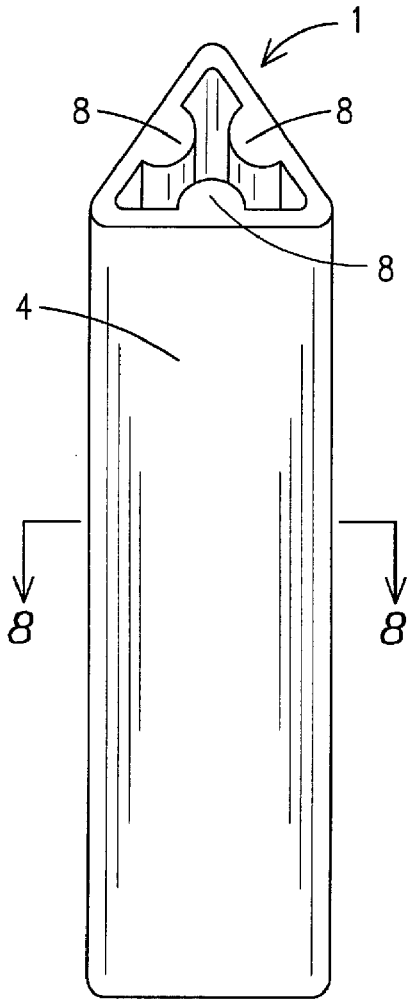
FIG. 7 is a top perspective view of a cake support tube of the present invention having a triangular shaped perimeter wall.

With reference to FIGS. 5 and 6, an exploded perspective side view and a side plan view, respectively, of multi-tiered cake 9 having a plurality of cake support tubes 1 of the present invention located within a first tier 10 of the multi-tiered cake 9 are shown. The method for assembling a multi-tiered cake 9 is to first place each tier 10 and 11 of the cake 9 on a cardboard base 12. Then, cake support tubes 1 are measured and cut in lengths equal to the height of the first tier 10. Next, the cake support tubes 1 are inserted vertically around the center of the first tier 10 so that the bottom ends 3 of the cake support tubes 1 make contact with the cardboard base 12 under the first tier 10 and so that the top ends 2 of the cake support tubes 1 are flush with the top 13 of the first tier 10. Then, the second tier 11 is placed on top of the first tier 10 so that the cardboard base 12 of the second tier 11 is resting on the top ends 2 of the cake support tubes 1. This process is then repeated for each additional tier that is to be added to the cake 9.

It is to be understood that while a preferred embodiment of the invention is illustrated, it is not to be limited to the specific form or arrangement of parts or use herein described and shown. For instance, although the support tube of the present invention having profiles of various shapes has been described for use in supporting multi-tiered cakes, such support tubes could also be used for other purposes, such as drive shafts, posts, fences, structural supports and so forth. It will be apparent to those skilled in the art that various changes may be made without departing from the scope of the invention and the invention is not be considered limited to what is shown and described in the specification and drawings.

We claim:

1. A support tube comprising:

a substantially round perimeter wall having a top end, a bottom end, an inner surface and an outer surface;

at least two substantially round shaped raised ridges located on the inner surface running the entire length of the support tube longitudinally from the top end of the perimeter wall to the bottom end of the perimeter wall; and any inner surface located between the at least two substantially round shaped raised ridges is curved in the opposite direction then the said at least two substantially round shaped raised ridges.

2. The support tube of claim 1 wherein:

said perimeter wall is made of a brightly colored material so the support tube may be easily identified to prevent ingestion when using the support tube is being used in a cake.

* * * * *